United States Patent [19]

Kochanowski

[11] Patent Number: 4,494,492

[45] Date of Patent: Jan. 22, 1985

[54] LIQUID-COOLED POWER AGGREGATE OR ENGINE HAVING AN ARRANGEMENT FOR SUPPRESSING VIBRATION

[75] Inventor: Hans-Alfred Kochanowski, Ruhstorf, Fed. Rep. of Germany

[73] Assignee: Motorenfabrik Hatz GmbH & Co. KG, Ruhstorf, Fed. Rep. of Germany

[21] Appl. No.: 482,361

[22] Filed: Apr. 5, 1983

[30] Foreign Application Priority Data

Feb. 10, 1983 [DE] Fed. Rep. of Germany ..... 3304587

[51] Int. Cl.[3] ..... F01P 3/02

[52] U.S. Cl. ..... 123/41.84; 123/41.3

[58] Field of Search ..... 123/41.01, 41.3, 41.42, 123/41.44, 41.45, 41.5, 41.71, 41.15, 668, 669, 41.84

[56] References Cited

U.S. PATENT DOCUMENTS

| | | | |
|---|---|---|---|
| 1,495,088 | 5/1924 | Larson | 123/41.3 |
| 1,721,846 | 7/1929 | Atzberger | 123/41.5 |
| 2,115,193 | 4/1938 | Burris | 123/41.42 |
| 2,394,199 | 2/1946 | Myers | 123/413 |
| 4,202,310 | 5/1980 | Zorrilla et al. | 123/668 |

FOREIGN PATENT DOCUMENTS

| | | |
|---|---|---|
| 252735 | 8/1926 | United Kingdom . |
| 769254 | 3/1957 | United Kingdom . |
| 850676 | 10/1960 | United Kingdom . |
| 978837 | 12/1964 | United Kingdom . |
| 1126265 | 9/1968 | United Kingdom . |

*Primary Examiner*—William A. Cuchlinski, Jr.

*Attorney, Agent, or Firm*—Flynn, Thiel, Boutell & Tanis

[57] ABSTRACT

An internal combustion engine has a sleeve in which the piston reciprocates during operation, as a result of which the sleeve is heated and tends to vibrate. The engine casing includes walls which define a space around the sleeve through which a liquid coolant is conveyed to cool the sleeve. A compressible member or medium is provided in such space or in the coolant therein and suppresses vibrations within the coolant, thereby minimizing the extent to which vibrations from the sleeve are transmitted through the coolant to the engine casing and produce noise in the region around the engine. In one preferred embodiment, the compressible medium is a plurality of gas bubbles distributed throughout the coolant. In another preferred embodiment, a compressible member is provided in the space adjacent the sleeve.

8 Claims, 6 Drawing Figures

10
12
38
10b
10c
22a
32
28
22
24
26
29
20
18
16
14
30
34
12a
10a
10d
10e 10
12
36
10b
10c
22a
32
28
22
24
26
29
20
18
16
14
30
34
12a
36
10a
10d
10e 10
12
42
10b
10c
22a
32
28
22
24
26
29
20
18
16
14
30
34
12a
10a
42
10d
10e 10
12
40
10b
10c
22a
32
28
22
24
26
29
20
18
16
14
30
34
12a
10a
40
10d
10e

LIQUID-COOLED POWER AGGREGATE OR ENGINE HAVING AN ARRANGEMENT FOR SUPPRESSING VIBRATION

FIELD OF THE INVENTION

This invention relates to an engine or power aggregate adapted to suppress vibrations and, more particularly, to such a device in which the arrangement which suppresses vibrations is disposed in passageways for a coolant.

BACKGROUND OF THE INVENTION

This invention relates to a power aggregate or engine having a casing with at least one internal wall which, during operation of the aggregate or engine, is thermally stressed and subjected to vibration, and in which the aggregate or engine has at least one space between such internal wall and an outer wall of the casing in which a liquid coolant is circulated to cool the internal wall. Typically, water or oil is used as a coolant in aggregates or engines of this character. In practice, a problem is that the coolant in the aforesaid space is practically incompressible and carries the vibrations developed during operation of the aggregate or engine directly to the outer walls of the engine casing, thereby producing considerable noise emission from the engine or aggregate. This phenomenon is particularly noticeable in internal combustion engines in the regions of the cylinder which encloses the combustion chamber and the cylinder head which contains the valves and the inlet and exhaust ducts, and leads to a substantial production of noise in the vicinity of the engine.

SUMMARY OF THE INVENTION

It is an object of the present invention to circumvent these deficiencies in liquid-cooled power aggregates and engines and to bring about a substantial reduction in the amount of sound which is transferred through the liquid coolant from the point of generation to the outer casing of the aggregate or engine. This object is accomplished in the present invention by introducing into the space for the coolant around the cylinder at least one easily compressible medium or member which, by virtue of its inherent compressibility, suppresses the vibrations which are induced during engine operation in the inner wall and at least partially transmitted by the liquid coolant, so that the transfer of these vibrations to the casing is reduced.

As an easily compressible medium, use may be made, as a special feature of the invention, of a bubble-forming gas (for example helium) or gas mixture (for example air or exhaust gas) which is added to the coolant or mixed therewith. It is also or alternatively possible to add small, compressible, free-floating particles, for example of a foam material, to the coolant flowing in the aforementioned space.

A further possibility within the invention is to introduce into the space for the coolant several elastic, free-floating sachets preferably made from plastic foil and filled with a gas or gas mixture.

Another possibility is to spray one or both inner surfaces of the engine casing which define this space with layers of fluent material which will swell to form compressible dampening layers under the action of the coolant. Polyester or polyether could, for example, be the sprayed material.

Another embodiment of the invention resides in applying or attaching, and preferably cementing, to the inner and/or outer sides of the walls defining the space, layers of a closed-pore, compressible foam material. Similarly and advantageously, instead of one endless layer, several segmented and separated layers of vibration suppressing material could be used, depending on prevailing working conditions.

Application of the deadening layers could, for example, take place during assembly by spraying them on, whereby such layers are converted into a slightly compressible condition by the action of the coolant.

BRIEF DESCRIPTION OF THE DRAWINGS

A number of embodiments of the invention, as implemented in an internal combustion engine, are described below with reference to the accompanying drawings. In the drawings.

DETAILED DESCRIPTION

Figure 1:
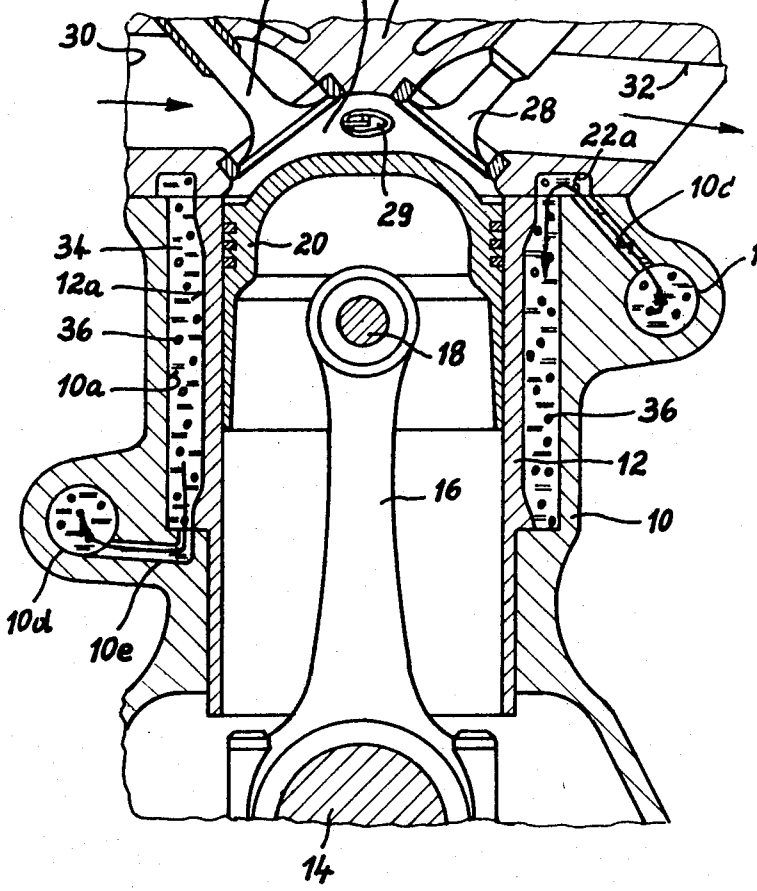
FIG. 1 is a fragmentary longitudinal sectional view of a water-cooled internal combustion engine which has vibration suppressing bubbles in the cooling water.

Illustrated in FIG. 1 is an internal combustion engine of conventional construction. It includes a crankcase 10 in which is provided an upstanding cylindrical sleeve or cylinder 12. A crankshaft 14 is rotatably supported in the crankcase 10 and is connected by a connecting rod 16 and a transverse pin 18 to a piston 20 which can be reciprocated vertically within the cylinder 12. The combustion chamber defined by the cylinder 12 and a cylinder head 22 is designated by reference numeral 24. Provided in the cylinder head 22 in a known fashion are a fuel intake valve 26, an exhaust valve 28 and an ignition plug 29 (or there could be an injector nozzle). The intake and exhaust ducts have the reference numerals 30 and 32, respectively.

Defined between the inner surface **10*a* of the crankcase 10 and the outer surface 12*a* of the cylinder 12 is an annular space 34 of appropriate dimensions through which a liquid coolant flows, in the present instance cooling water. The cooling water enters through an inlet 10*b* under the action of a feed pump of known construction (not shown) and flows through a passage 10*c* into an annular chamber 22*a* provided in the underside of the cylinder head 22 and thence into the space 34. A return conduit 10*e* and an outlet connection 10*d*** are used to return the cooling water to a suitable conventional arrangement (also not shown) where the heated water is cooled. From there, the coolant water is again conveyed by the feed pump previously mentioned to the cooling chamber in the internal combustion engine.

The cooling water within the cooling system is mixed, according to the present invention, with a readily compressible medium, which in the illustrated case is air, in order to generate a plurality of air bubbles 36 in the cooling system. A mixture having suitable proportions of water to air is made before the engine is started and is controlled for a preset running period.

In this way, the freely floating air bubbles 36 are carried along with the circulating cooling water, are compressed by the vibrations within this water and, as a result of such compression, suppress to a substantial degree the transmission of vibrations emitted by the cylinder 12 through the cooling water to the crankcase 10 and thus to the outer jacket of the internal combustion engine. Undesirable noise in the environment around the internal combustion engine is thus considerably reduced.

Instead of adding air to the coolant, other gases, for example helium or some other gas (for example exhaust gases), can be mixed in.

An alternative method of vibration suppression is possible by adding to the coolant of the engine a plurality of small, compressible, freely floating particles instead of air bubbles, for example small spheres of a foam material, which produces a vibration dampening effect similar to that of the air bubbles.

Figure 2:
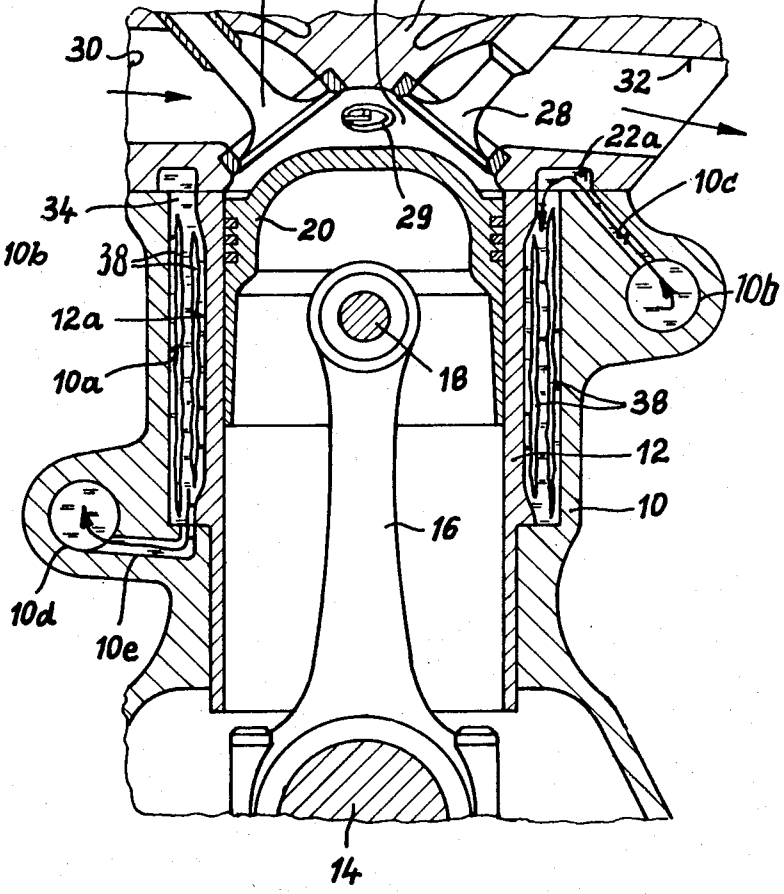
FIGS. 2 to 4 are views similar to FIG. 1 showing internal combustion engines of a construction similar to that of FIG. 1 but having other vibration suppressing arrangements introduced into the cooling water.

FIG. 2 illustrates another form of the invention. Here, a plurality of resilient plastic foil sacks or sachets 38 are provided which are filled with air or some other gas or gas mixture and then sealed. The individually sealed sachets 38 are introduced into the annular space 34 during assembly of the engine so that, after the introduction of cooling water into the space 34, they float freely. As a result of the inherent compressibility of the sachets 38, there is a vibration dampening effect similar to that of the construction described in connection with FIG. 1.

Figure 3:
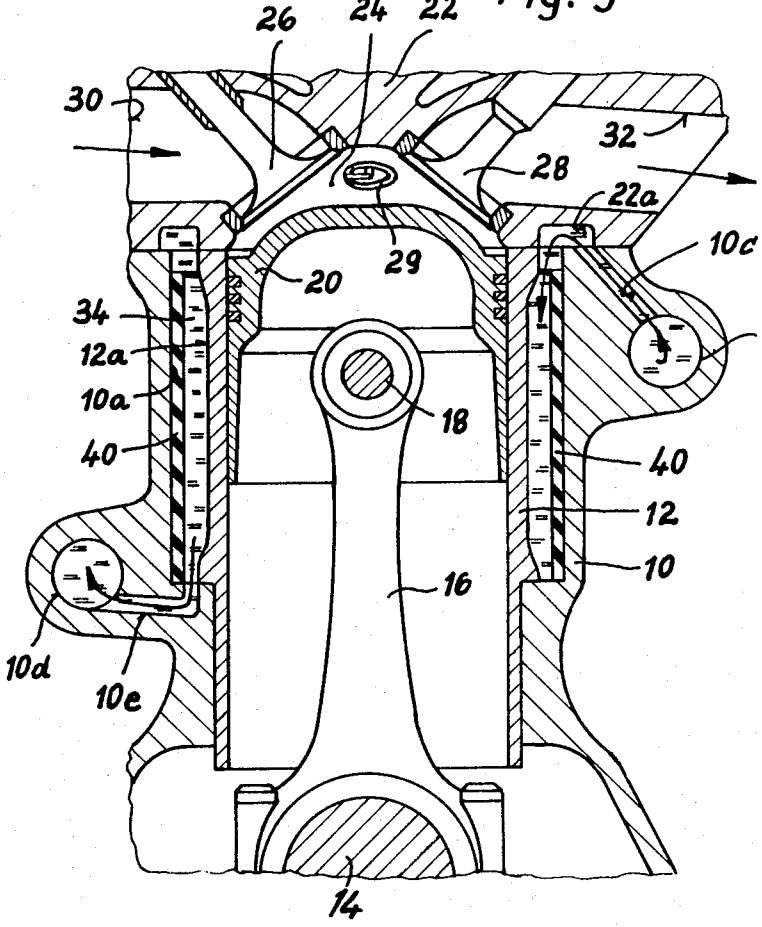

The embodiment of FIG. 3 illustrates another arrangement for vibration suppression. Here a sleevelike layer 40 of a closed-pore foam material is attached to the inner surface 10*a* of the crankcase 10, for example by being cemented thereto. As a result of its inherent compressibility, this layer 40 also dampens the transmission of vibrations from the cylinder 12 through the cooling water to the crankcase 10 and in this way reduces excessive creation of noise in the vicinity of the internal combustion engine.

Figure 4:
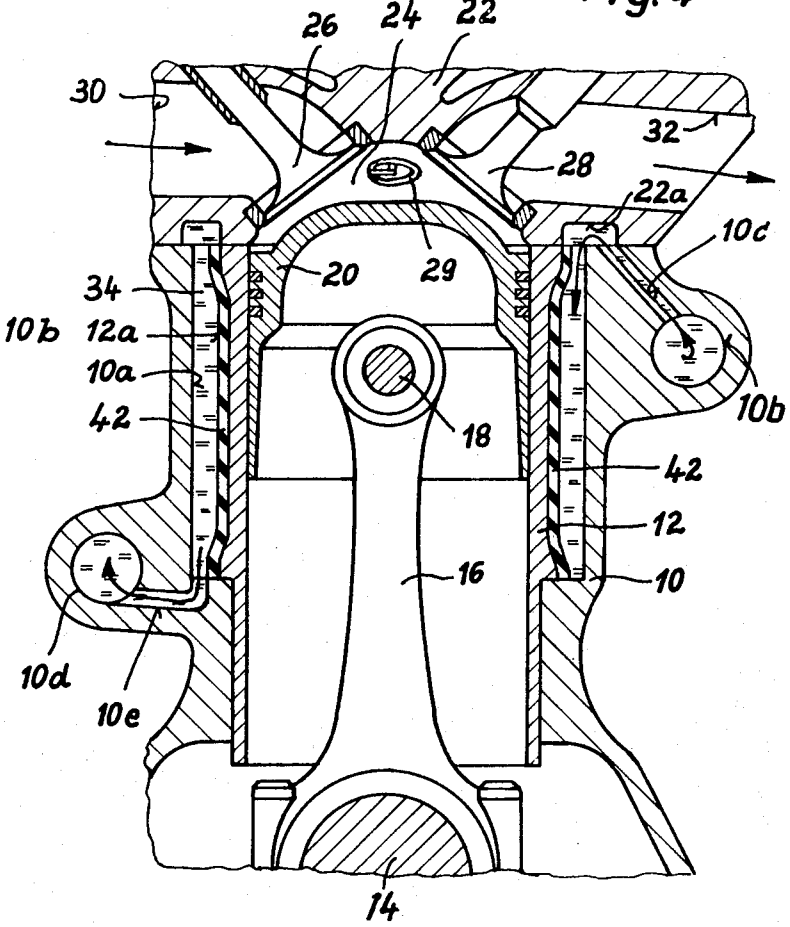

A further embodiment is shown in FIG. 4 and has a vibration suppressing layer of foam material 42 applied to the outside surface of the cylinder 12, which produces a dampening effect analogous to that of the layer 40 of FIG. 3. It is to be understood that the cooling water cannot act directly on the cylinder 12 in a construction of this nature, as a result of which there will be a minor reduction in the cooling effect. A constructional assembly of this nature will therefore only be used in internal combustion engines in which the cylinder is not subject to heavy thermal stress and thus where only a modest cooling effect is required.

The embodiments described can be used both with single cylinder and with multi-cylinder internal combustion engines. They can also be used with Otto-engines such as Diesel engines or with rotary engines. The embodiments described can also be used where there is oil cooling or other liquid cooling.

Figure 5:
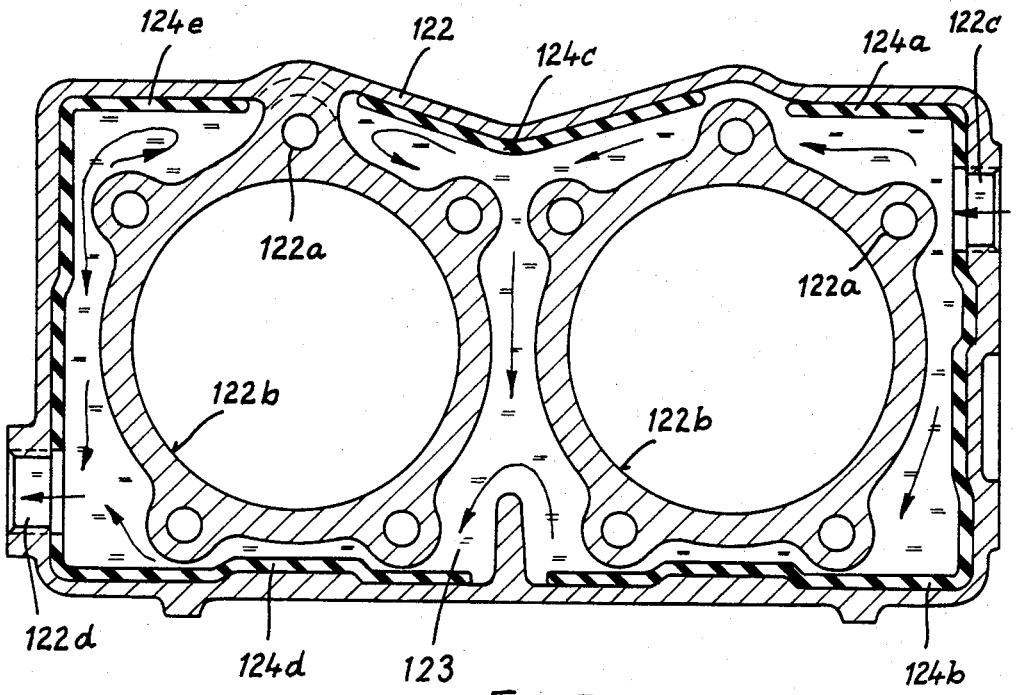
FIG. 5 is a horizontal longitudinal sectional view of the cylinder block of a water-cooled internal combustion engine having vibration suppressing layers provided in the hollow spaces for the cooling water.

FIG. 5 is a top view of a horizontal cross section through a cylinder block 122 of a water-cooled two-cylinder internal combustion engine with two upright cylinders which are surrounded by a space 123 for the cooling water. Holes 122*a* in the block 122 receive fastening screws (not shown) to connect the cylinder block 122 and the cylinder head (not shown) to the crankcase of the engine. Two piston chambers 122*b* can also be seen. Above the piston chambers are the inlet and discharge valves (not shown) as well as the inlet and exhaust ducts within the cylinder head.

Threaded openings 122*c* and 122*d* for the cooling water inlet and discharge conduits are provided on the block 122. The inside surfaces of the outer walls of the space 123 within the cylinder block 122 are lined with a plurality of separated layers 124*a* to 124*e* of a closed-pore foam plastic material, which are for example cemented to the associated walls. These have the same dampening effect as the layers 40 and 42 of FIGS. 3 and 4.

Figure 6:
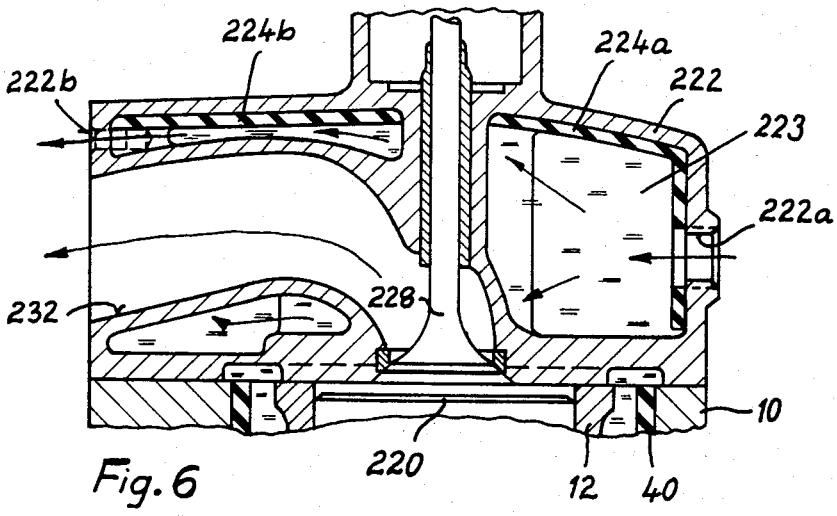
FIG. 6 is a fragmentary vertical sectional view through a water-cooled cylinder head which has vibration suppressing layers in the hollow spaces for the cooling water.

FIG. 6 is a cross-sectional side view through a cylinder head 222. The exhaust valve 228 is disposed above the piston 220, which is movable in the cylinder 12, and the exhaust conduit is designated with the reference numeral 232. The cylinder head 222 is connected to a cooling water system, for which purpose appropriately threaded inlet 222*a* and outlet 222*b* openings are provided. The outer walls of the cooling water space 223 provided in the cylinder head 222 is lined (for example by cementing) with vibration dampening foam plastic layers 224*a* and 224*b*.

Layers of foam material which always have a constant degree of compressibility in any condition can be used. It is, however, also possible to apply in a dry condition layers which have little or no compressibility to the walls and to subsequently convert them into slightly compressible dampening layers by the addition of the coolant media.

Further, a fluent material could be sprayed onto the walls and be subsequently converted into compressible dampening layers by the action of coolant. There is no difficulty in adapting the thickness of a layer at any time to the appropriate prevailing conditions. The application during assembly in accordance with the type employed presents no problems.

It should also be stated that, in the case of the constructions of FIGS. 5 and 6, the dampening arrangements described in connection with FIGS. 1 and 2 could also optionally be used. Finally, it is noted that the dampening arrangements which have been described in connection with the cooling system of an internal combustion engine could be used for other power aggregates or engines of a similar nature, for example with liquid-cooled compressors.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a mechanism which includes: a casing having at least one internal wall which, during operation of said mechanism, is thermally stressed and subjected to vibration, and an outer wall spaced from said inner wall; and means defining a space between said inner wall and said outer wall of said casing, said space being part of a liquid cooling system of said mechanism and said liquid cooling system being adapted to cause a liquid coolant to be circulated through said space to cool said casing and said inner wall thereof; the improvement comprising easily compressible means provided in said space for suppressing, during operation of said mechanism and by virtue of its inherent compressibility, a transfer of vibrations produced during operation of said mechanism in said inner wall from said inner wall through said liquid coolant to said outer wall, said compressible means including a layer of a closed-pore, compressible foam material in said space which is supported on an internal surface of one of said inner and outer walls.

2. The mechanism according to claim 1, including a liquid-cooled internal combustion engine having a movable piston and having a cylinder wall guiding said piston and defining part of a combustion chamber therefor, said cylinder wall being said inner wall.

3. The mechanism according to claim 2, wherein said layer of said foam material is attached to the inner surface of said outer wall.

4. The mechanism according to claim 2, wherein said layer of said foam material is secured to the outer surface of said cylinder wall.

5. The mechanism according to claim 2, wherein said layer of said foam material has the shape of a sleeve and is mounted concentrically on said cylinder wall.

6. The mechanism according to claim 1, including a liquid-cooled internal combustion engine having a thermally highly stressed cylinder head which movably supports plural valves, which has inlet and exhaust ducts therein, and which has means defining a space therein communicating with said liquid cooling system, wherein a further layer of said closed-pore foam material is secured to an inner surface of said cylinder head which faces said space therein.

7. The mechanism according to claim 6, wherein a plurality of separate pieces of said foam material are secured to respective surfaces of said cylinder head which each face said space.

8. The mechanism according to claim 2, wherein said layer of said foam material is applied in a dry condition to said surface of said casing and subsequently becomes slightly compressible in response to the introduction of said liquid coolant into said liquid cooling system.

* * * * *